US011572870B2

(12) United States Patent
Plantard

(10) Patent No.: US 11,572,870 B2
(45) Date of Patent: Feb. 7, 2023

(54) PNEUMATIC PUMP SILENCER, PNEUMATIC PUMP COMPRISING SUCH A SILENCER AND COATING PRODUCT SPRAYING INSTALLATION COMPRISING AT LEAST ONE SUCH PNEUMATIC PUMP

(71) Applicant: EXEL INDUSTRIES, Epernay (FR)

(72) Inventor: Nicolas Plantard, Paris (FR)

(73) Assignee: EXEL INDUSTRIES, Epernay (FR)

( * ) Notice: Subject to any disclaimer, the term of this patent is extended or adjusted under 35 U.S.C. 154(b) by 307 days.

(21) Appl. No.: 16/831,725

(22) Filed: Mar. 26, 2020

(65) Prior Publication Data

US 2020/0309108 A1 Oct. 1, 2020

(30) Foreign Application Priority Data

Mar. 28, 2019 (FR) ..... 1903255

(51) Int. Cl.
*F04B 39/00* (2006.01)
*F04B 37/20* (2006.01)
*G10K 11/162* (2006.01)

(52) U.S. Cl.
CPC ..... *F04B 39/0027* (2013.01); *F04B 37/20* (2013.01); *G10K 11/162* (2013.01)

(58) Field of Classification Search
CPC ..... F04B 39/0027; F04B 39/005; F04B 39/0083; F04B 37/20; F04B 17/00; F05B 2260/962; F02B 77/13; F01B 31/005; G10K 11/162; B05B 9/0409; B05B 9/085
See application file for complete search history.

(56) References Cited

U.S. PATENT DOCUMENTS 3,635,125 A * 1/1972 Rosen ..... F01B 31/005 91/55
3,789,954 A 2/1974 Raleigh
5,097,924 A * 3/1992 Reeves ..... F01N 1/082 181/239
5,626,467 A 5/1997 Cantley
2003/0074914 A1* 4/2003 Hirakanu ..... G05D 7/0647 62/527
2008/0063512 A1* 3/2008 Nakamura ..... F04B 39/0033 415/119

(Continued)

FOREIGN PATENT DOCUMENTS

JP S56139875 U 10/1981
WO 2015144317 A1 10/2015
WO WO-2015144317 A1 * 10/2015 ..... B05B 9/0403

OTHER PUBLICATIONS

Silicone Rubber—https://web.archive.org/web/20190228232319/https://en.wikipedia.org/wiki/Silicone_rubber (Year: 2019).*

(Continued)

*Primary Examiner* — Essama Omgba
*Assistant Examiner* — Geoffrey S Lee
(74) *Attorney, Agent, or Firm* — Soquel Group, LLC

(57) ABSTRACT

A pneumatic pump silencer including a body defining an inner volume and having at least one wall including an air outlet orifice, and an attenuating pad having a face arranged across from the air outlet orifice, wherein a gap is arranged between the face of the attenuating pad and an outer face of the wall including the air outlet orifice, the thickness of the gap being between 0.5 mm and 5 mm.

16 Claims, 5 Drawing Sheets

(56) References Cited

U.S. PATENT DOCUMENTS

2008/0250919 A1* 10/2008 Strong ..... F15B 15/204
251/298
2012/0285454 A1* 11/2012 Nibu ..... F04D 29/4246
128/204.18

OTHER PUBLICATIONS

ASTM D2240-00 webpage (obtained from https://www.astm.org/d2240-00.html, Aug. 3, 2022) (Year: 2017).*
Durometer Chart (obtained from https://www.smooth-on.com/assets/pdf/durometer_chart.pdf, Aug. 3, 2022) (Year: 2019).*
INPI Rapport de Recherche Préliminaire for Patent Application No. FR 1903255, Oct. 17, 2019, 2 pp.

* cited by examiner

PNEUMATIC PUMP SILENCER, PNEUMATIC PUMP COMPRISING SUCH A SILENCER AND COATING PRODUCT SPRAYING INSTALLATION COMPRISING AT LEAST ONE SUCH PNEUMATIC PUMP

CROSS-REFERENCE TO RELATED APPLICATION

This application claims priority of French Patent Application No. 19 03255, filed on Mar. 28, 2019.

FIELD OF THE INVENTION

The present invention relates to a pneumatic pump silencer, including a body defining an inner volume and having at least one wall including an air outlet orifice, this pneumatic pump silencer further including an attenuating pad with a face arranged across from the air outlet orifice.

BACKGROUND OF THE INVENTION

In general, the pneumatic pumps include a pneumatic motor actuated by compressed air. Pneumatic piston pumps generally include two variable volume chambers arranged around a piston mounted on a shaft, these two variable volume chambers being alternately supplied with compressed air and connected to an air exhaust, to move the piston in an alternating motion. The motion of the piston is reacted by the shaft and used to drive another piece of equipment, such as a liquid coating product pump.

When a chamber is connected to the air exhaust, the compressed air leaving the pneumatic motor is not directly released into the open air, since the abrupt expansion of the compressed air would cause significant noise nuisances, due to the fact that, in general, the compressed air is not yet at atmospheric pressure. It is therefore known to use an exhaust circuit including noise attenuation systems, called silencers.

The principle of some known silencers is to completely enclose the air exhaust orifice and to allow the compressed air to spread through a porous material, whether a cellular foam, or a ceramic material, or a metal or plastic material formed by partially sintered beads. These porous materials can be integrated within ready-to-use silencers. These silencers remain relatively cumbersome and cannot be integrated within a cover of the pneumatic motor.

Due to the cooling caused by the abrupt expansion of the compressed air, the moisture contained in the air risks condensing and accumulating in the collector and the silencer. In the case of the continuous use of a pneumatic pump, the pneumatic pump collector and silencer can be subject to icing, which reduces the exhaust air passage cross-section and reduces the performance of the pneumatic pump.

SUMMARY OF THE DESCRIPTION

The invention more specifically aims to address this problem, by proposing a pneumatic pump silencer preventing the accumulation of condensation water, not subject to icing, even in case of intensive use, and compact enough to be integrated into the cover of the pneumatic pump.

To that end, the invention relates to a pneumatic pump silencer of the aforementioned type, wherein a gap is arranged between the face of the attenuating pad and an outer face of the wall including the air outlet orifice, this gap having a thickness of between 0.5 mm and 5 mm.

Owing to the invention, the pneumatic pump silencer allows a better discharge of the condensation water toward the outside of the silencer, which prevents the icing of the silencer and guarantees sustainable inversion performance in case of intensive use. The exhaust of the pneumatic pump is not stifled, which guarantees clear inversions and better usage comfort.

According to advantageous but optional aspects of the invention, such a pneumatic pump silencer may incorporate one or more of the following features, considered in any technically allowable combination:

the attenuating pad is made from a porous material, the Shore hardness of which is greater than or equal to 20;

the material of the attenuating pad is an elastomer, the Shore hardness of which is between 20 and 100, preferably between 30 and 40, still more preferably equal to 35;

the material of the attenuating pad has a porosity ratio of between 0 and 0.75;

the attenuating pad completely covers the air outlet orifice, the area of the face of the attenuating pad arranged across from the air outlet orifice being greater than or equal to 120% of the area of the air outlet orifice, preferably greater than or equal to 150% of the area of the air outlet orifice;

the orientation of the gap allows a gravitational evacuation of the condensation water;

the attenuating pad is mounted on the body with a support fastened on the body, the support defining, with the side wall including the air outlet orifice, a receiving volume of the pad, and the attenuating pad is mounted with a possibility of bringing the outer face closer to and further from the wall including the air outlet orifice.

According to another aspect, the invention relates to a pneumatic pump including an air motor and at least one air exhaust orifice:

the pneumatic pump includes an air motor with two variable volume chambers separated by a piston, a subassembly for distributing air toward the variable volume chambers and discharging air from these variable volume chambers, this air distribution subassembly including at least one air exhaust orifice; the pneumatic pump further includes a pneumatic pump silencer arranged downstream from the air exhaust orifice in the flow direction of the exhaust air, the inner volume of the body of the pneumatic silencer capping the air exhaust orifice;

the pneumatic pump includes two air exhaust orifices and a pneumatic pump silencer arranged downstream from each air exhaust orifice in the direction of flow of the exhaust air, the inner volume of the body of each pneumatic silencer capping a corresponding air exhaust orifice;

the distribution subassembly and the pump silencer are placed in the inner volume of a casing closed by a layer of open-cell foam, preferably made from polyurethane.

The invention also relates to a spraying installation for a coating product including at least one pneumatic pump as mentioned above, as well as a pump for a coating product driven by this pneumatic pump.

This coating product spraying installation offers the same effects as those mentioned above regarding the pneumatic pump silencer of the invention.

BRIEF DESCRIPTION OF THE DRAWINGS

The invention will be better understood, and other advantages thereof will appear more clearly, in light of the following description of one embodiment of a pneumatic pump silencer, a pneumatic pump and a spraying installation according to its principle, provided solely as a non-limiting example and done in reference to the appended drawings, in which.

DETAILED DESCRIPTION

A same direct orthonormal coordinate system XYZ is shown in each of the figures, and the "top" and "bottom" directions for the interpretation of terms such as "top", "bottom", "upper", "lower", "below" are directions that are to be considered along axis Z and corresponding to a mounted configuration of the pneumatic pump or its component elements.

Figure 1:
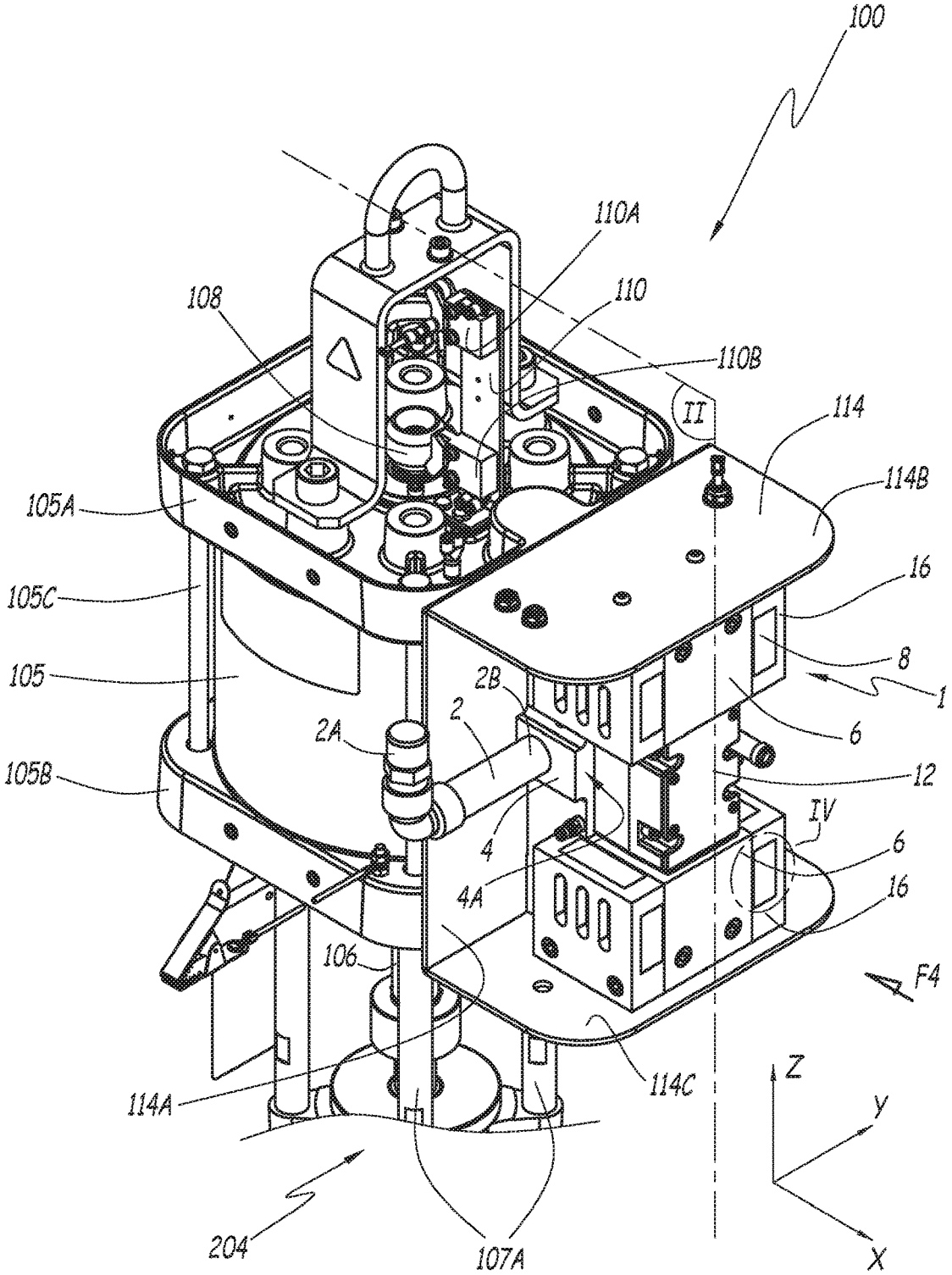
FIG. 1 is a perspective view of a pneumatic pump according to the invention.

A pneumatic pump 100 is shown in FIG. 1. Pneumatic pump 100 is shown in the mounted configuration, certain elements having been omitted to facilitate the understanding of the operation of pneumatic pump 100.

Pneumatic pump 100 includes a pump cylinder 105 with a circular section and oriented along an axis Z105 parallel to axis Z.

Pump cylinder 105 is closed, at one end, by an upper cover 105A and, at another end, by a lower cover 105B. Upper cover 105A and lower cover 105B have a similar structure and are arranged across from one another at the two ends of pump cylinder 105. Each cover includes an inner part 105D, this inner part 105D having a circular section and being able to be inserted into pump cylinder 105, this insertion being sealed using O-rings 1051J. Each cover 105A and 105B further includes an outer part 105E.

The face of each outer part 105E, whose normal is parallel to axis Z and moving away from cylinder 105, includes several bosses that themselves have bores, able to accommodate various fastening members such as screws. In particular, the bored bosses of lower cover 105B accommodate metal rods 107A, these rods 107A forming a chassis of a pump 204 for a liquid product belonging to a spraying installation 200 shown in FIG. 5 and which includes, aside from pneumatic pump 100 and liquid product pump 204, a sprayer 206 and a pipe 208 fluidly coupling pump 204 to sprayer 206 in order to transfer the liquid product from pump 204 to sprayer 206.

Figure 5:
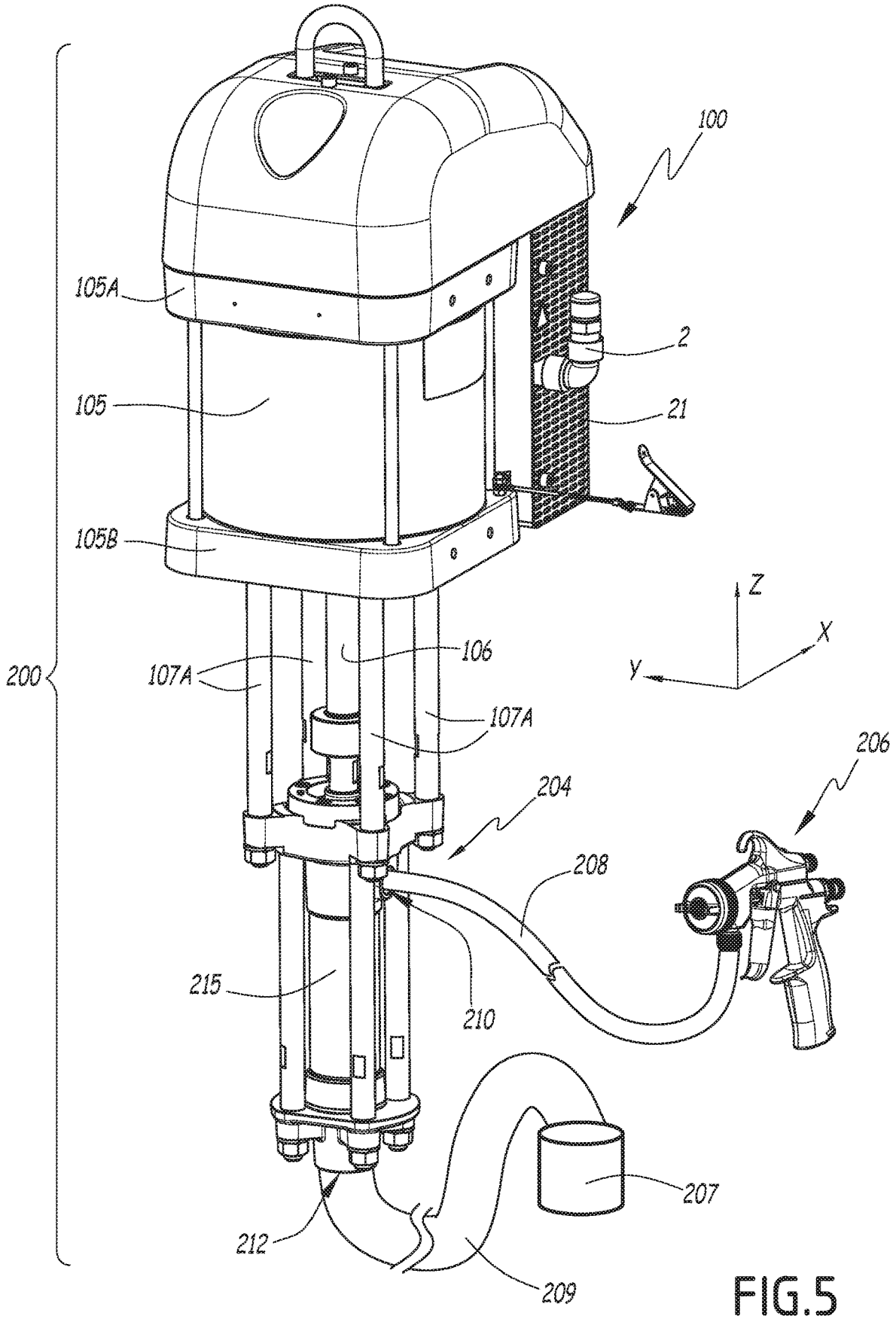
FIG. 5 is a partial perspective view of an installation for spraying coating product comprising the pump of FIGS. 1 to 4.

Sprayer 206, suitable for spraying a liquid product on a target surface, not shown in the figures, is for example a manual gun as in FIG. 5, or an automatic sprayer, known in itself. The sprayer is preferably of the airless type, i.e., capable of spraying the liquid product without adding spray air. In this sense, installation 200 is an installation of the airless type. To that end, the pressure of the liquid product supplied by pump 4 to sprayer 6 must be high, for example greater than 30 bars.

Liquid product pump 204 includes a body 215 in which a suction opening is formed, or an opening 212 for suctioning the liquid product, as well as a discharge opening, or outlet 210 for injecting the liquid product toward sprayer 206 through pipe 208. Inlet opening 202 is, for example, equipped with a nonreturn gate. Inlet opening 212 is fluidly coupled to a liquid product tank 207, through a pipe 209.

Body 215 inwardly delimits a cylindrical compression chamber, in which a piston, not shown, is mounted sliding along an axis parallel to axis Z. The piston of liquid product pump 204 is secured to a piston 104 of pneumatic pump 100 and coupled to the latter by a shaft 106, i.e., liquid product pump 204 is driven by pneumatic pump 100.

Upper cover 105A and lower cover 105B are kept in place by fastening rods 105C.

Pneumatic pump 100 also includes piston 104 located inside pump cylinder 105. Piston 104 is mounted on shaft 106, the axis of which is axis Z105. Furthermore, shaft 106 passes through upper cover 105A and lower cover 105B, the sealing between shaft 106 and upper cover 105A and lower cover 105B being provided by sealing members, described in more detail below.

Piston 104, with a circular section, is inserted into pump cylinder 105, a sealing gasket 104) mounted at the periphery of piston 104 providing the sealing of the contact with pump cylinder 105. The volume defined by pump cylinder 105, piston 104 and upper cover 105A is called upper chamber 102A, and similarly, the volume defined by pump chamber 105, piston 104 and lower cover 105B is called lower chamber 102B. Piston 104 being translatable along axis Z105, the position of piston 104 within pump cylinder 105 changes, and the volume of upper chamber 102A and lower chamber 102B thereby also changes. Upper chamber 102A and lower chamber 102B are therefore variable volume chambers.

An upper duct 112A is arranged in upper cover 105A. One end of upper duct 112A emerges in inner part 105D of upper cover 105A in upper chamber 102A. The other end of upper duct 112A emerges from the outer part 105E on a side face of upper cover 105A in a direction parallel to axis X and moving away from axis Z105. Similarly, a lower duct 112B is arranged in lower cover 105B. One end of lower duct 112B emerges in inner part 105D of lower cover 105B in lower chamber 102B. The other end of lower duct 112B emerges from outer part 105E on a side face of lower cover 105B in a direction parallel to axis X and moving away from axis Z105.

A contact support 110 is fastened to outer part 105E of upper cover 105A. Contact support 110 assumes the form of an elongated rectangular plate, the large side of which is oriented along axis Z, contact support 110 being oriented perpendicular to the direction of axis Y. Contact support 110 includes a lower end, near upper cover 105A, and an upper end, further from upper cover 105A.

A lower contact 110B is fastened to contact support 110 near its lower end, and an upper contact 110A is fastened to contact support 110 near its upper end. Upper contact 110A and lower contact 110B each include a lever 111 and a bearing roller 111A.

Pneumatic pump 100 also includes a casing 114. Casing 114 is made up of a bottom 114A, an upper rim 114B and a lower rim 114C. Bottom 114A is flat, arranged in the plane of axes Z and Y, i.e., normal to axis X. Upper rim 114B and lower rim 114C extend across from one another, perpendicular to bottom 114A, along the direction of axis X. Bottom 114A, upper rim 114B and lower rim 114C define a housing, the inner volume of which is denoted V114.

A lower passage 116B is arranged in bottom 114A of casing 114 near lower rim 114C. Holes 120 with axes parallel to axis X are arranged on either side, in the direction of axis Y, of lower passage 116B. Similarly, an upper passage 116A is also arranged in bottom 114A of casing 114 near upper rim 114B. Bores 120 are also arranged in bottom 114A on either side of upper passage 116.

Pneumatic pump 100 also includes an air supply member 2. Member 2 has a free end 2A, configured to be connected to an external compressed air source, such as a compressor or a tank, not shown. The compressed air generates the alternating movement of piston 104 and shaft 106. Air supply member 2 has another end 2B, connected to a base 4. Base 4 globally has a parallelepiped shape, the faces of which are orthogonal to axes X, Y and Z. Base 4 has, on one of the faces normal to axis X, a platen 4A, from which several ducts and air passages emerge. From bottom to top, one can thus see a lower exhaust duct 43B, a lower air passage 42B, an air intake duct 41, an upper air passage 42A and an upper exhaust duct 43A.

Figure 2:
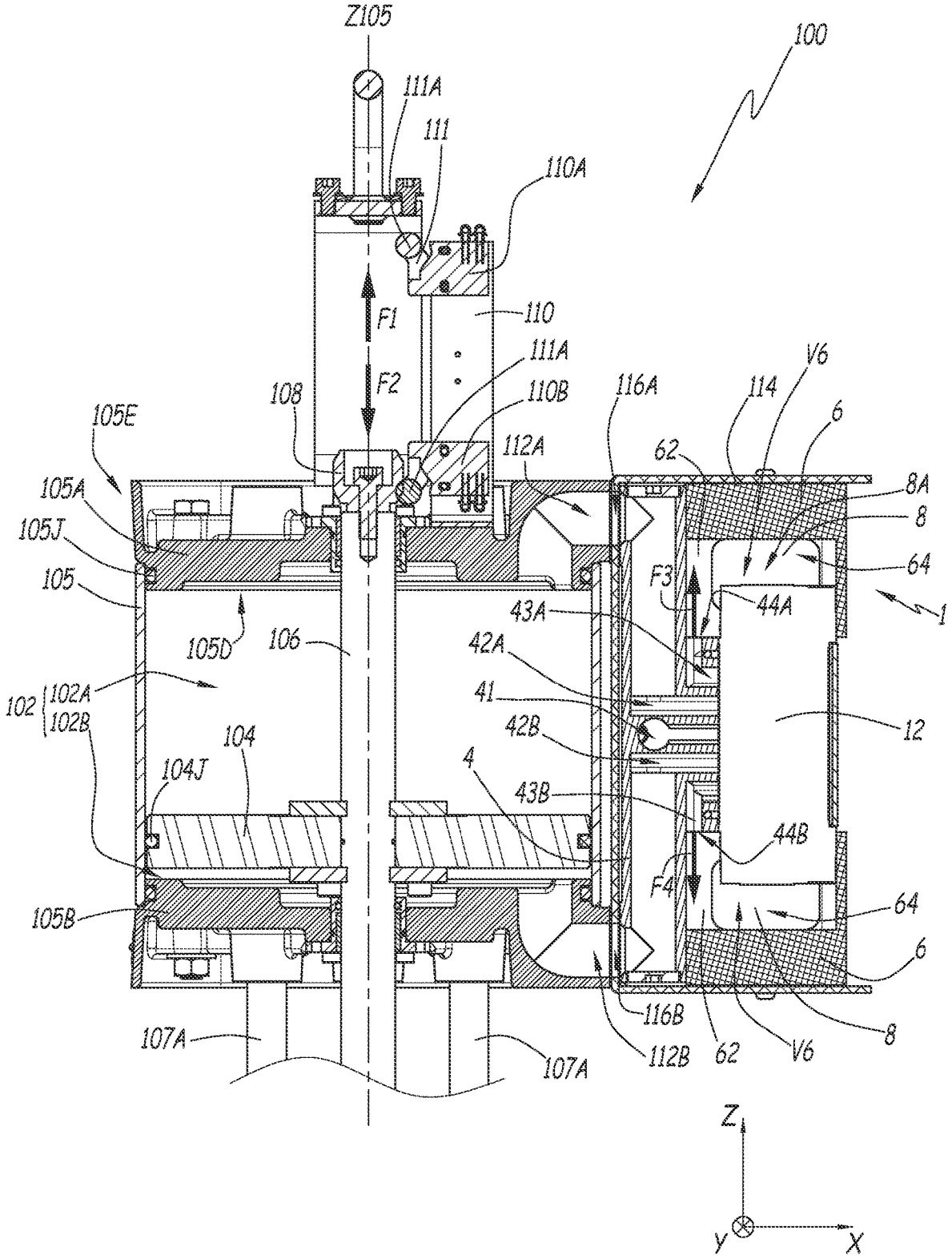
FIG. 2 is a cross-sectional view of the pneumatic pump along plane II in FIG. 1.

The path of the various ducts and air passages is visible in FIG. 2, where base 4 is shown in cross-section. In particular, upper air passage 42A and lower air passage 42B each have an end emerging on platen 4A, the other respective end of upper air passage 42A and lower air passage 42B emerging on base 4 by the opposite face of platen 4A, i.e., the face oriented toward casing 114, across from upper passage 116A and lower passage 116B, respectively. The upper exhaust duct 43A and lower exhaust duct 43B each have an end emerging on platen 4A, the other end being an upper air exhaust orifice 44A or a lower air exhaust orifice 44B, respectively arranged in the upper or lower side of platen 4A and parallel to axis Z.

Air intake duct 41 emerges at one end on platen 4A and at the other end on one of the side faces of platen 4A, normal to axis Y.

Bores 4B are further arranged on platen 4A, the axes of these bores 4B being parallel to axis X. Through holes 46 are arranged in base 4 near upper and lower faces, the axis of these through holes being parallel to axis X.

An air distributor 12 is arranged across from platen 4A. Air distributor 12 has a globally parallelepiped shape, the faces of which are normal to axes X, Y and Z. Air distributor 12 includes bores, not referenced, parallel to axis X and able to receive fastening screws 12A.

For the clarity of the drawing, distributor 6, which is known in itself, is shown in outside view in FIG. 2.

In FIG. 2, piston 104 is in a so-called lower position, i.e., piston 104 abuts against lower cover 105B, lower chamber 102B then having a minimum volume and upper chamber 102A having a maximum volume.

A cam 108 is fastened to shaft 106 and therefore follows the same alternating upward movements, along arrow F1, or downward movements, along arrow F2. In the lower position as shown in FIG. 2, cam 108 is in contact with bearing roller 111A of lower contact 110B. Lower contact 110B and upper contact 110A have a similar structure, with a bearing roller 111A fastened to a lever 111, lever 111 in turn being connected to the body of upper contact 110A or lower contact 110B. Upper and lower contacts 110A and 110B operate as valves, allowing compressed air to pass when bearing roller 111A is moved and interrupting the passage when bearing roller 111A is in its nominal position. The control air circuits of the upper and lower contacts are not shown in the figures of the present disclosure. In FIGS. 1 and 2, cam 108 moves over bearing roller 111A of lower contactor 110B.

As its name indicates, the role of air distributor 12 is to distribute the air coming from air intake duct 41 toward an upper air passage 42A or a lower air passage 42B and simultaneously to connect the other of upper air passage 42A and lower air passage 42B to the corresponding exhaust ducts, i.e., in the case of upper air passage 42A, the upper exhaust duct 43A, and in the case of lower air passage 42B, to lower exhaust duct 43B. Air distributor 12 is controlled pneumatically by control compressed air circuits connected to each of upper contact 110A and lower contact 110B.

When pneumatic pump 100 is mounted, air distributor 12 is fastened to platen 4A of base 4 using fastening screws 12A cooperating with bores 4B arranged in platen 4A. Air distributor 12 thus mounted on base 4 and base 4 together define an air distribution subassembly 14. When pneumatic pump 100 is mounted, air distribution subassembly 14 is placed in inner volume V114 of casing 114, upper air passage 42A then being aligned with upper passage 116A arranged in bottom 114A of casing 114 and upper duct 112A arranged in upper cover 105A. Similarly, lower air passage 42B of base 4 is then aligned with lower passage 116B of bottom 114A of casing 114 of lower duct 112B of lower cover 105B. The assembly of air distribution subassembly 14, casing 114 and upper cover 105A and lower cover 105B includes sealing members able to provide a sealed connection between upper air passage 42A, upper passage 116A and upper duct 112A on the one hand, and between lower air passage 42B, lower passage 116B and lower duct 112B on the other hand.

In the situation of FIGS. 1 and 2, the pneumatic command sent by lower contact 110B controls air distributor 12, and as a result, air intake duct 41 is connected to lower air passage 42B through air distributor 12 and upper air passage 42A is connected to upper exhaust duct 43A. Upper chamber 102A is then coupled, by means of upper duct 112A, from upper passage 116A and upper air passage 42A, to upper exhaust duct 43A and thus to air exhaust orifice 44A. The pressure therein is then substantially equal to the atmospheric pressure.

Conversely, the compressed air coming from air supply 2 passing successively through intake duct 41, air distributor 12, lower air passage 42B, lower passage 116B and lower duct 112B, then arrives in lower chamber 102B, which is then at a pressure substantially equal to the pressure of the compressed air supplied by air supply 2. Under the effect of the pressure, piston 104A moves along axis Z105 in the direction of arrow F1, i.e., upward.

Just before the inversion of air distributor 12, upper chamber 102A is still at the pressure of the compressed air coming from the air intake duct. During the inversion of air distributor 12, upper chamber 102A is suddenly connected to air exhaust orifice 44, causing an abrupt expansion of the exhaust air, which is reflected by a potentially significant noise and cooling related to the decompression of the compressed air.

The compressed air naturally moves from the high-pressure areas toward the low pressure areas. More generally, when one of the variable volume chambers 102A and 102B, initially under pressure, is connected to one of upper exhaust duct 43A or lower exhaust duct 43B, the flow of the compressed air is done respectively in the direction of arrow F3 or F4 up to the level of air exhaust orifice 44A or 44B. This flow direction defines the downstream direction relative to each air exhaust orifice 44A or 44B.

After the inversion of air distributor 12, piston 104 therefore moves upward, until cam 108 reaches bearing roller 111A of upper contact 110A. Under the effect of the pneumatic control signal sent by upper contact 110A to air distributor 12, air distributor 12 inverts itself again.

Lower chamber 102B, which until now was coupled to air supply 2 by means of lower duct 112B, lower passage 116B and lower air passage 42B, is suddenly connected to lower exhaust duct 43B, which in turn is connected to air exhaust orifice 44B. Conversely, upper chamber 102A, which until now was in an exhaust situation, finds itself connected to air supply 2 by means of various passages, already disclosed. Under the effect of the pressure inversion, piston 104 is pushed in the direction of arrow F2 and is lowered again until reaching the lower position, where cam 108 comes into contact with bearing roller 111A of lower contact 110B, which is in the state shown in FIG. 1 and FIG. 2.

The cycle thus disclosed of the alternating movements of piston 105 and shaft 106 is transmitted to liquid product pump 204.

Pneumatic pump 100 further includes a foam layer 20 and a perforated cap 21. Foam layer 20 assumes the form of a plate with thickness E20.

Pneumatic pump 100 further includes two pneumatic pump silencers 1.

A pneumatic pump silencer 1 includes a globally cubic body 6, the faces of which are normal to axes X, Y and Z. Body 6 is hollowed out and defines an inner volume V6. Inner volume V6 emerges on two of the faces of body 6, these faces being adjacent, the normal of one of them being parallel to axis X and oriented toward the casing, the normal of the other face being parallel to axis Z. Body 6 has two side walls 62 that are normal to axis Y. Reference 62A denotes the outer face of each side wall 62, i.e., the face whereof the normal along Y moves away from body 6.

Air outlet orifice 64 is arranged in each side wall 62, i.e., air outlet orifice 64 passes through wall 62 and emerges in inner volume V6 and outside body 6. An air outlet orifice 64 is arranged substantially centered on the corresponding side wall 62.

Body 6 further includes a solid wall 65 and a front wall 68. In the mounted configuration of pump 100, solid wall 65 is normal to axis Z and front wall 68 is parallel to axes Y and Z.

The normal to front wall 68 is parallel to axis X and moves away from the casing. Two through-holes 68A are further arranged in front wall 68 parallel to axis X, these through-holes 68A passing through body 6 in the thickness of solid wall 65.

Side walls 62 are also pierced with bores 66 oriented parallel to axis Y, these bores 66 also being arranged in the thickness of solid wall 65.

Each pneumatic pump silencer 1 also includes two attenuating tabs 8, these attenuating tabs 8 consisting of identical plates of parallelepiped shape, the faces of which are normal to axes X, Y and Z. Reference E8 denotes the thickness of a tab 8 measured along axis Y. An attenuating tab 8 has a first face 8A normal to axis Y, as well as a second upper face 8B and a third lower face 8C, these faces 8B and 8C being normal to axis Z.

Two through-holes 82 are arranged in first face 8A of tab 8 near the ridge between first face 8A of tab 8 and second face 8B. Furthermore, guide notches 81 are arranged in first face 8A of tab 8 near third face 8C, these guide notches having a rectangular section in the plane normal to axis Y.

Each pneumatic pump silencer 1 also includes two identical supports 16. Each support 16 includes a rectangular bottom 16A, oriented perpendicular to axis Y. On one of the ridges parallel to axis X of bottom 16A, a support 16 includes a bearing rim 16B, bearing rim 16B being parallel to axes X and Y and, on the other ridge parallel to axis X of bottom 16A, this support 16 including two spacing feet 16C oriented parallel to axis Y on the same side of bottom 16A as bearing rim 16B.

Spacing feet 16C have a substantially rectangular cross-section in the plane orthogonal to axis Y. The end of bearing rim 16B and the ends of spacing feet 16C are normal to axis Y and are additionally in the same plane parallel to axes X and Z. Bottom 16A of a support 16, its bearing rim 16B and spacing feet 16C define a volume V16 for receiving a pad 8, and reference P16 denotes the depth of the volume 16, measured parallel to axis Y.

Through-holes 16D are further arranged in bottom 16A of each support 16 parallel to axis Y, near the ridge between bottom 16A and bearing rim 16B, these through-holes 16D emerging in receiving volume V16.

Each pump silencer 1 further comprises first screws 18A and second screws 18B, first screws 18A being shorter than second screws 18B.

When a pneumatic pump silencer 1 is mounted, each attenuating pad 8 is housed in receiving volume V16 of a support 16. Spacing feet 16C and guide notches 8B have complementary shapes that cooperate, to within any assembly plays, in order to limit the movements of attenuating pad 8 in receiving volume V16, only a translation of attenuating pad 8 relative to support 16, in a direction parallel to axis X, being authorized.

When a pump silencer 1 is mounted, bearing rim 16B and spacing feet 16C of its supports 16 are in contact with a side wall 62 of its body 6. Furthermore, through-holes 16D of a support 16 are aligned with one of bores 66 of body 6, allowing the placement of first screws 18. Each support 16 is then fastened to body 6.

When an attenuating pad 8 is inserted into a receiving volume V16 of a support 16, through-holes 82 of attenuating pad 8 are also aligned with through-holes 16D of this support 16. The diameter of through-holes 82 is chosen to be slightly larger than the diameter of first screws 18 so as not to limit the translational movements of attenuating pad 8 along the axis of first screws 18A.

Depth P16 is strictly greater than thickness E8 of attenuating pad 8. As a result, when support 16 is fastened to body 6 using first screws 18A and attenuating pad 8 is placed in receiving volume V16, pad 8 being shimmed against bottom 16A of support 16 under the effect of the pressure from the exhaust air of variable chamber 102A or 102B, attenuating pad 8 is not in contact with outer face 62A adjacent to side wall 62 of body 6. A gap 10 is thus formed between the first face of pad 8A and adjacent outer face 62A of side wall 62 of body 6. Reference E10 denotes the thickness of the gap, measured parallel to axis Y. This thickness E10 is non-nil.

Figure 3:
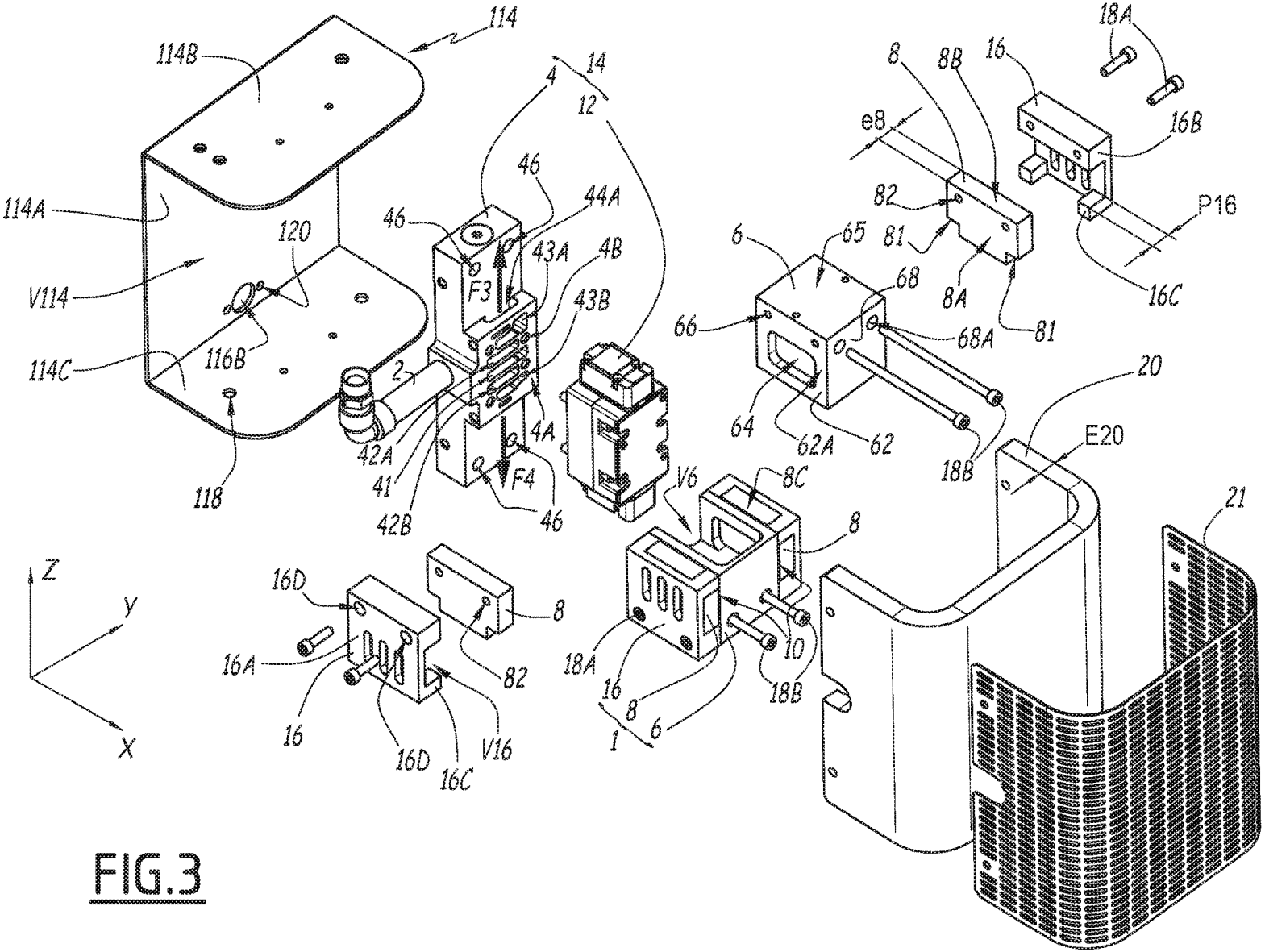
FIG. 3 is a partial exploded perspective view of the pneumatic pump of FIGS. 1 and 2 showing, inter alia, pneumatic pump silencers according to the invention.

The assembly of supports 16, attenuating pads 8 and body 6 using first screws 18A makes it possible to constitute pneumatic pump silencer 1, this pump silencer 1 in turn being assembled to air distribution subassembly 14 using second screws 18B that pass through through-holes 68A of body 6 and through-holes 46 of base 4, which cooperate with tapped bores 120 of casing 114. In this assembled situation, body 6 of each silencer is in contact with base 4 and an air exhaust orifice 44A or 44B emerges in inner volume V6 of body 6, as shown in FIG. 2. In FIGS. 2 and 3, arrows F3 and F4 show the direction of the air leaving air exhaust orifices 44A and 44B. The exhaust air leaving exhaust orifices 44A and 44B first spreads within inner volume V6. In other words, body 6 caps air exhaust orifice 44.

Upon each decompression, the cooling of the abruptly decompressed air promotes the condensation of the moisture present in the air, or even the formation of ice inside pump ducts and silencers designed according to the state of the art.

A pneumatic pump silencer 1 according to the invention is compact enough to allow it to be integrated within inner volume V114 of casing 114 on each air exhaust orifice 44A or 44B. The decompression of the exhaust air in inner volume V6 of body 6 is faster than it would be in a collector according to the state of the art, which makes the inversions of distributor 12 cleaner, improving the productivity of pneumatic pump 100. The reduced bulk of pump silencer 1 makes it possible to place a pneumatic pump silencer 1 according to the invention on each of air exhaust orifices 44A and 44B, while limiting the bulk within inner volume V114 of casing 114. This makes it possible to place the second sound absorption element, consisting of foam layer 20 and closing distribution subassembly 14 capped with pneumatic pump silencers 1 within inner volume V114 of casing 114.

Foam layer 20 is, in this example, a polyurethane foam plate, which is shaped and kept in place by perforated cap 21. Various openings are arranged in foam layer 20 in order in particular to allow the fastening members of cap 21 to pass, or air supply member 2, as shown in FIG. 3. Foam layer 20 enclosing, within casing 114, distribution subassembly 14 and pneumatic pump silencers 1, the exhaust air must pass through foam layer 20 in order to escape. To that end, the material of foam layer 20 must have open cells. Foam layer 20 may, for example, be made from open-cell polyurethane foam.

Figure 4:
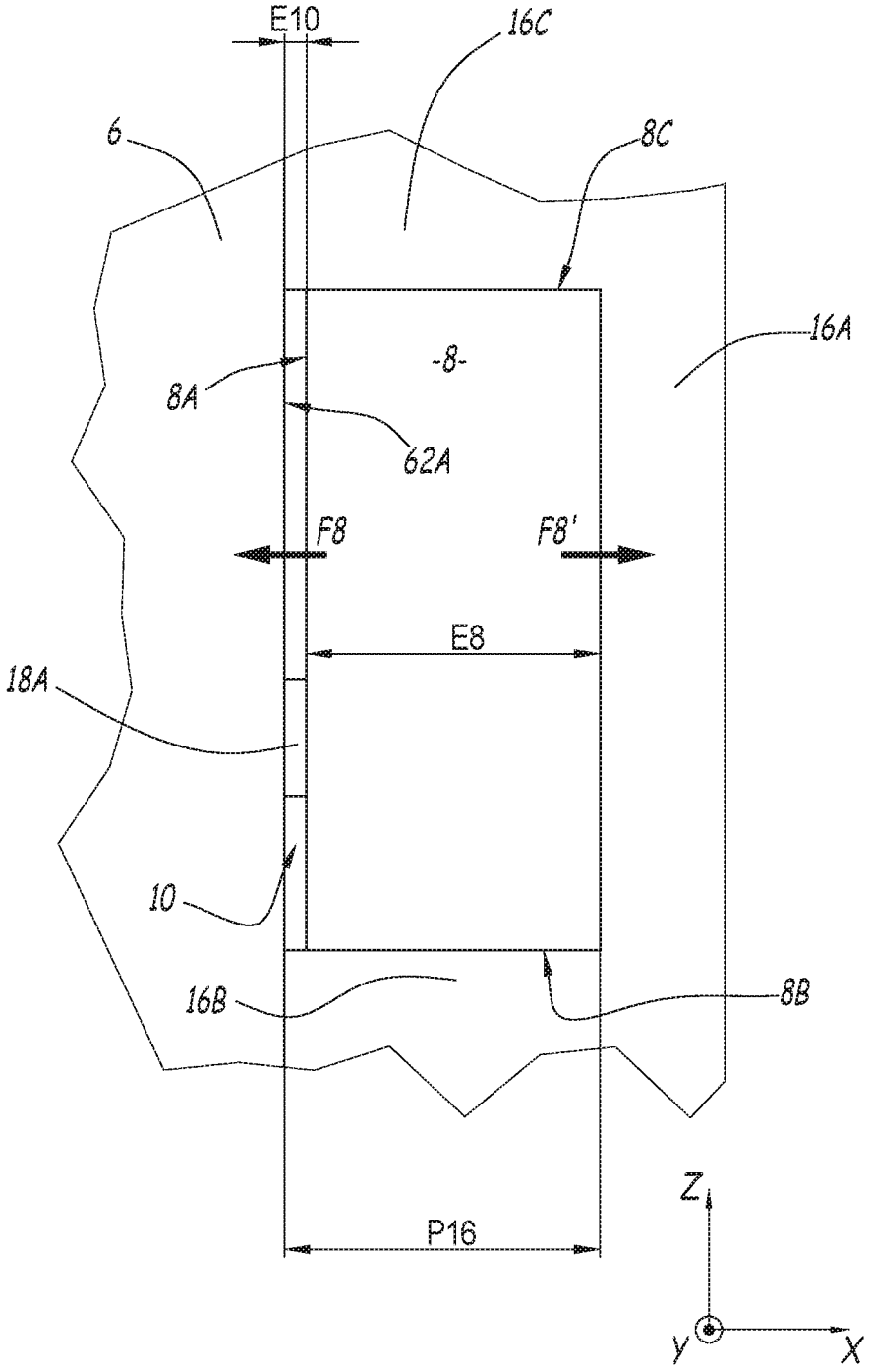
FIG. 4 is a front view of detail IV of FIG. 1, seen in the direction of arrow F4.

When the exhaust air leaves from an air exhaust orifice 44A or 44B, it finds itself in inner volume V6 of body 6 of silencer 1 capping this air exhaust orifice 44A or 44B, and expands in the entire available space of inner volume V6. The pressure from the exhaust air then exerts a force on attenuating pads 8, this pressure force being normal to first face 8A of each pad 8. Each attenuating pad 8, when it is placed in receiving volume V16 of support 16, has a certain play and may in particular move in translation along the axis of screws 18A, which passes through attenuating pad 8, as shown by arrows F8 and F8' in FIG. 4. Thickness E8 of attenuating pad 8 being strictly less than the depth of support 16, attenuating pad 8 finds itself, under the force of the pressure from the exhaust air, pressed against bottom 16A of support 16. The space between the first face of pad 8A and outer face 62A of side wall 62 of body 6 thus constitutes gap 10.

The exhaust air leaving from one of air exhaust orifices 44A or 44B passes through an inner volume V6, then through a gap 10 to be next found in inner volume V114 of casing 114. The condensation water that has optionally formed in an inner volume V6 during the abrupt decompression of the exhaust air leaving from exhaust air orifice 44A or 44B is driven by the air passing through gap 10. Additionally, gap 10 being located in a vertical plane, i.e., parallel to axis Z, it authorizes the gravitational flow of the condensation water generated in inner volume V6. The condensation water thus discharged from each pneumatic pump silencer 1 then finds itself within inner volume V114 of casing 114. A discharge of condensation water 118 is arranged in lower rim 114C of casing 114 to avoid the accumulation of condensation water in casing 114.

The exhaust air leaving from air exhaust orifice 44 generates sound waves due to its abrupt decompression. Attenuating pads 8 are made from a porous material able to absorb the sound waves.

The material used to produce attenuating pads 8 must be rigid enough, because an attenuating pad 8 made from an overly soft material would not withstand the repeated shock waves from the exhaust air released upon each inversion of air distributor 12. Rigid enough means that the Shore hardness of the material must be at least 20. If an elastomer material is used for attenuating pad 8, the Shore hardness of the material must be between 20 and 100, preferably between 30 and 40. Porous materials meeting these hardness conditions are, for example, closed-cell polyurethane foams or rubber. In the case of rubber, an example of a Shore hardness satisfying the invention is 35 shore.

In a variant that is not shown, attenuating pad 8 may be made from a porous metal, for example partially sintered bronze beads. According to another variant, attenuating pad 8 may be made from porous ceramic.

The porosity ratio of the component material of attenuating pad 8 may be defined by the ratio between the volume of empty spaces and the total volume of a porous medium. In practice, this porosity ratio is expressed as follows:

$$\varphi = V_{pores}/V_{total}$$

where $\varphi$ is the porosity ratio $V_{pores}$ is the volume of the pores of the porous medium $V_{total}$ is the total volume of the material, i.e., the sum of the solid volume and volume of the pores.

This porosity ratio $\varphi$ is preferably chosen with a value of between 0 and 0.75.

According to another definition, the porosity of the component material of attenuating pad 8 may be defined by an air flow rate passing through this pad under a given pressure difference, expressed in MPa.

Schematically, the attenuation of the sound waves of the exhaust air is accomplished, during the passage of the exhaust air in gap 10, by the multiple reflections of the sound waves between outer face 62A of side wall 62 of body 6 and first face 8A of pad 8. A gap 10 with an overly reduced thickness E10 is not desirable, since the exhaust air would not be able to escape quickly enough and the inversion of air distributor 12 would be stifled. Conversely, a gap 10 with an overly large thickness E10 would reduce the efficacy of the attenuation of the sound waves, since this would amount to an escape directly in the open air, i.e., with no attenuation device.

In practice, a gap 10 with thickness E10 smaller than 0.5 mm tends to stifle the pneumatic pump, whereas a gap 10 with thickness E10 greater than 5 mm no longer has any attenuating effect. Thus, thickness E10 is between 0.5 mm and 5 mm. Preferably, a gap 10 with thickness E10 between 1 and 3 mm is satisfactory. A thickness E10 of between 1.5 and 2.5 mm is desirable. A gap 10 with thickness E10 equal to 2 mm yields good results.

Similarly, the length of gap 10, measured along any direction perpendicular to axis Y, must be sufficient in order to allow multiple reflections of the sound waves between first face 8A of pad 8 and outer face 62A of body 6. Air outlet orifice 64 is arranged in side wall 62 in a substantially centered manner. Seen in a direction parallel to axis Y, attenuating pad 8 completely covers air outlet orifice 64, preferably attenuating pad 8 greatly exceeds the edges of air outlet orifice 64. In practice, the area of first face 8A of pad 8 arranged across from air outlet orifice 64 is greater than or equal to 120% of the area of air outlet orifice 64, preferably greater than or equal to 150% of the area of air outlet orifice 64. This means that preferably, the covering of air outlet orifice 64 by attenuating pad 8 is evenly distributed all the way around air outlet orifice 64.

Pneumatic pump 100 of the disclosed embodiment includes two identical pump silencers 1, each including two identical attenuating pads 8. In a variant, other structures may be considered, with, as a first example, a pneumatic pump 100 only including one silencer, optionally mounted on a collector, and as a second example, pump silencers 1 including only one attenuating pad 8, or conversely, three or more attenuating pads 8.

In still another variant, the two attenuating pads 8 of a silencer 1 may be different.

In a variant, attenuating pad 8 of a silencer 1 may be made from a nonporous material, i.e., a material having a porosity ratio equal to zero.

The invention is not limited to coating product spraying. Pump 204 may be implemented to move other liquids, such as water, oil, ink or a single- or dual-component liquid glue. Furthermore, pneumatic pump 100 may be used to drive a piece of equipment other than a pump, for example a pneumatic valve.

The embodiment and variants mentioned above may be combined with one another to create new embodiments of the invention.

The invention claimed is:

1. A pneumatic pump silencer for the decompression of exhaust air used in a pneumatic pump, the pneumatic silencer comprising:

a body defining an inner volume configured to cap an air exhaust orifice of the pneumatic pump, and comprising at least one wall comprising an air outlet orifice, the inner volume emerging outside the body through the outlet orifice; and an attenuating pad comprising a face arranged across from said air outlet orifice, wherein a gap is arranged between said face of said attenuating pad and an outer face of said at least one wall, and wherein the inner volume emerges, through the gap, into air at atmospheric pressure, and wherein a thickness of the gap is between 0.5 mm and 5 mm.

2. The pneumatic pump silencer according to claim 1, wherein the thickness of the gap is between 1 and 3 mm.

3. The pneumatic pump silencer according to claim 1, wherein the thickness of the gap is between 1.5 and 2.5 mm.

4. The pneumatic pump silencer according to claim 1, wherein the thickness of the gap is equal to 2 mm.

5. The pneumatic pump silencer according to claim 1, wherein said attenuating pad is made from a porous material.

6. The pneumatic pump silencer according to claim 1, wherein a material of said attenuating pad is an elastomer.

7. The pneumatic pump silencer according to claim 1, wherein a material of said attenuating pad has a porosity ratio of between 0 and 0.75.

8. The pneumatic pump silencer according to claim 1, wherein said attenuating pad completely covers said air outlet orifice, an area of said face of said attenuating pad being greater than or equal to 120% of an area of said air outlet orifice.

9. The pneumatic pump silencer according to claim 1, wherein said attenuating pad completely covers said air outlet orifice, an area of said face of said attenuating pad being greater than or equal to 150% of an area of said air outlet orifice.

10. The pneumatic pump silencer according to claim 1, wherein an orientation of the gap allows a gravitational flow of the condensation water generated in the inner volume, the condensation water flowing through the gap without accumulating within the inner volume.

11. The pneumatic pump silencer according to claim 1, wherein said attenuating pad is mounted on said body with a support fastened on said body, the support defining, with said at least one wall, a receiving volume of said attenuating pad.

12. The pneumatic pump silencer according to claim 1, wherein, when the pump silencer is mounted, said attenuating pad is mounted such that the outer face may be brought closer to and further from said at least one wall.

13. A pneumatic pump, comprising:

an aft motor comprising two variable volume chambers separated by a piston;

a subassembly for distributing air toward said two variable volume chambers and discharging aft from said two variable volume chambers, the subassembly comprising at least one aft exhaust orifice; and at least one pneumatic pump silencer according to claim 1, the at least one pneumatic silencer being arranged downstream from said at least one air exhaust orifice in a flow direction of the exhaust aft, wherein the inner volume of the body of the pneumatic pump silencer caps said at least one aft exhaust orifice.

14. The pneumatic pump according to claim 13, wherein said at least one aft exhaust orifice comprises two aft exhaust orifices, wherein said at least one pneumatic pump silencer comprises two pneumatic pump silencers, each pneumatic pump silencer being arranged downstream from each of said two aft exhaust orifices in the direction of flow of the exhaust aft, with the inner volumes of the bodies of each pneumatic pump silencer capping corresponding ones of said two air exhaust orifices.

15. The pneumatic pump according to claim 13, wherein said subassembly and said pneumatic pump silencer are placed in an inner volume of a casing closed by a layer of open-cell foam.

16. An installation for spraying coating products, comprising:

at least one pneumatic pump according to claim 13; and a coating product pump driven by said at least one pneumatic pump.

* * * * *